US011440067B2

(12) United States Patent
Dirisamer et al.

(10) Patent No.: US 11,440,067 B2
(45) Date of Patent: Sep. 13, 2022

(54) LUBRICATING DEVICE FOR APPLYING A LUBRICANT WHEN ROLLING A ROLLING MATERIAL

(71) Applicant: Primetals Technologies Austria GmbH, Linz (AT)

(72) Inventors: Gernot Dirisamer, Tollet (AT); Paul Felix Dollhäubl, Zwettl an der Rodl (AT); Michael Lang, Feldkirchen (AT); Bernhard Schinagl, Ansfelden (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 954 days.

(21) Appl. No.: 16/305,104

(22) PCT Filed: May 31, 2017

(86) PCT No.: PCT/EP2017/063139
§ 371 (c)(1),
(2) Date: Nov. 28, 2018

(87) PCT Pub. No.: WO2017/207622
PCT Pub. Date: Dec. 7, 2017

(65) Prior Publication Data

US 2020/0269295 A1 Aug. 27, 2020

(30) Foreign Application Priority Data

Jun. 2, 2016 (EP) ..... 16172663

(51) Int. Cl.
*B05B 1/20* (2006.01)
*B05B 7/04* (2006.01)
(Continued)

(52) U.S. Cl.
CPC ..... *B21B 27/10* (2013.01); *B05B 1/20* (2013.01); *B05B 7/04* (2013.01); *B21B 45/0251* (2013.01);
(Continued)

(58) Field of Classification Search
CPC .. B05B 7/05; B05B 1/20; B05B 1/202; B05B 1/205; B21B 45/0233; B21B 45/0251;
(Continued)

(56) References Cited

U.S. PATENT DOCUMENTS 4,638,950 A * 1/1987 Collinson ..... B21B 45/0233 251/30.05
4,709,568 A 12/1987 Ticehurst et al. ..... 72/201
(Continued)

FOREIGN PATENT DOCUMENTS

CH 686 072 A5 12/1995
CN 104105553 A 10/2014
(Continued)

OTHER PUBLICATIONS

Korean Notice to File a Response, dated Feb. 25, 2021, issued in corresponding Korean Patent Application No. 10-2018-7034834. Total 10 pages.
(Continued)

*Primary Examiner* — Jason J Boeckmann
(74) *Attorney, Agent, or Firm* — Ostrolenk Faber LLP

(57) ABSTRACT

A lubrication device (1) for applying a lubricant when rolling a rolling material. The lubrication device (1) includes an extruded profile (3), through which run lubricant ducts (41) and at least one carrier medium duct (42), at least one connection block (5, 6) and nozzles (7). The connection block (5, 6) is connected to the extruded profile (3) and has lubricant connection ducts (54) that are each connected to one lubricant duct (41) of the extruded profile (3). The
(Continued)

nozzles (7) are connected to the extruded profile (3) and are designed to create and emit a lubricant-carrier medium mixture consisting of lubricant and a carrier medium.

14 Claims, 7 Drawing Sheets

(51) Int. Cl.
*B21B 27/10* (2006.01)
*B21B 45/02* (2006.01)

(52) U.S. Cl.
CPC ..... *B21B 45/0233* (2013.01); *B21B 2027/103* (2013.01)

(58) Field of Classification Search
CPC ... B21B 45/0248; B21B 45/026; B21B 27/10; B21B 2027/103
USPC ..... 239/549, 550, 55
See application file for complete search history.

(56) References Cited

U.S. PATENT DOCUMENTS

| | | | | |
|---|---|---|---|---|
| 4,738,400 | A * | 4/1988 | Irwin | B21B 37/32 239/536 |
| 6,450,000 | B2 | 9/2002 | Barten | 72/201 |
| 6,598,448 | B1 | 7/2003 | Barten et al. | 72/201 |
| 8,544,608 | B2 | 10/2013 | Vervaet | |
| 8,881,568 | B2 | 11/2014 | Nakata | |
| 9,433,984 | B2 | 9/2016 | Braidt et al. | |
| 2007/0029411 | A1* | 2/2007 | Huffman | B05B 15/658 239/548 |
| 2015/0013419 | A1 | 1/2015 | Braidt et al. | 72/236 |
| 2016/0325327 | A1* | 11/2016 | Boehm | B05B 7/0483 |
| 2018/0221894 | A1* | 8/2018 | Forgey | B05B 1/1609 |

FOREIGN PATENT DOCUMENTS

| | | | |
|---|---|---|---|
| EP | 0 153 532 | A2 | 9/1985 |
| EP | 0 205 295 | A2 | 12/1986 |
| EP | 0582056 | A2 | 2/1994 |
| EP | 0 904 849 | A2 | 9/1998 |
| EP | 1 142 652 | A2 | 10/2001 |
| EP | 1 142 653 | A2 | 10/2001 |
| EP | 2 465 619 | A1 | 6/2012 |
| JP | S 56-59168 | | 5/1981 |
| JP | S 58-110119 | A | 6/1983 |
| JP | S 61-293604 | | 12/1986 |
| JP | H 7-204715 | A | 8/1995 |
| JP | H 11-156268 | A | 6/1999 |
| JP | 2001-347305 | A | 12/2001 |
| JP | 2001-347307 | A | 12/2001 |
| JP | 2003181516 | A | 7/2003 |
| JP | 2006-096036 | A | 4/2006 |
| JP | 2008-264597 | A | 11/2008 |
| JP | 2009-202192 | A | 9/2009 |
| JP | 104907338 | A | 9/2015 |
| KR | 10-2010-0072203 | A | 6/2010 |
| KR | 10-2011-0018436 | A | 2/2011 |
| SU | 929269 | A1 | 5/1982 |
| SU | 986533 | A1 | 1/1983 |

OTHER PUBLICATIONS

Office Action dated Jul. 1, 2019 in corresponding Chinese Patent Application No. 201780034057.5.
International Search Report dated Jul. 14, 2017 in corresponding PCT International Application No. PCT/EP2017/063139.
Written Opinion dated Jul. 14, 2017 in corresponding PCT International Application No. PCT/EP2017/063139.
Extended European Search Report dated Sep. 6, 2016 in corresponding European Patent Application No. 16172663.3.
Russian Federation Decision to Grant, dated Aug. 30, 2019, issued in corresponding Russian Patent Application No. 2018144627/02(074474). English translation. Total 18 pages.
Notice of Allowance dated Feb. 3, 2020 issued in corresponding JP 2018-563153.

* cited by examiner

LUBRICATING DEVICE FOR APPLYING A LUBRICANT WHEN ROLLING A ROLLING MATERIAL

CROSS-REFERENCE TO RELATED APPLICATIONS

The present application is a 35 U.S.C. §§ 371 national phase conversion of PCT/EP2017/063139, filed May 31, 2017, which claims priority of European Patent Application No. 16172663.3, filed Jun. 2, 2016, the contents of which are incorporated by reference herein. The PCT International Application was published in the German language.

The invention relates to a lubricating device for applying a lubricant when rolling, especially cold rolling, a rolling material.

BACKGROUND OF THE INVENTION

The rolling material is in this case a metal rolling band which is guided through a roll gap between two rotating working rollers of a roll stand in order to reduce the thickness of the rolling band. By means of the lubricant, the friction between the rolling band and the working rollers in the roll gap is reduced. To this end, the lubricant is applied by the lubricating device, for example, onto a working roller or onto a support roller or onto the rolling material upstream of the roll gap.

Lubricating devices of this type in most cases have nozzles for spraying the lubricant. The arrangement of the nozzles depends in this case on a number of parameters. In particular, it depends on the distance between the nozzles and the surface onto which the lubricant is to be deposited. This distance results in turn from technological requirements of the lubricating profile creation and also from space requirements on existing roll stands. Furthermore, the nozzle arrangement depends on the spray angle of the nozzles which are to used, which angle influences the distance of the nozzles from each other. The complex dependency of the nozzle arrangement on such parameters hampers the construction of a lubricating device which can be used for different roll stands and rolling processes or which can be flexibly adapted to different roll stands and rolling processes.

Various devices and methods for applying a lubricant during rolling are known.

EP 1 142 652 A2 and EP 1 142 653 A2 disclose roller cooling devices and/or lubricating devices for cold band rolling mills with nozzle bars which are associated with the individual rollers, attached to the roll frames of a roll stand and into which spray nozzles are built over the width of the rollers. The nozzle bars can be displaced in the direction of their longitudinal axis, which is transversely to the running direction of the rolling band, by means of a linear drive, formed by actuating cylinders, and can be pivoted around the longitudinal axis by means of a rotary drive.

EP 2 465 619 A1 discloses a device and a method for applying a lubricant when rolling metal rolling material, wherein a mixture consisting of lubricant and a carrier gas is created in an atomization device. The mixture is fed to an arrangement of spray nozzles and by means of a common spray jet, the mixture is deposited onto the surface of at least one working roller and/or onto the surface of the rolling band.

CH 686 072 A5 discloses a spray system which adjoins a bar extrusion press and serves for the all-side cooling of metal profiles. The cooling media discharges from spray nozzles in a program-controlled manner in the direction of the profiles. The distance, the cross-section distribution and the direction of the spray nozzles are specifically adapted to the geometric shape and the mass distribution of the profiles.

EP 0 153 532 A2 discloses a spray bar in which are fastened unary membrane nozzles. The cooling medium is delivered in a longitudinal duct of a first bar section to the respective nozzles, whereas the duct in the second bar section contains the pressurized control medium (e.g. compressed air) which is required for operating the nozzles. For operating the membrane, each nozzle has an electromagnetic coil which is actuated via corresponding connections.

SUMMARY OF THE INVENTION

The invention is based on the object of providing a lubricating device for applying a lubricant when rolling a rolling material, which device is improved especially with regard to the adaptability of its production to different roll stands and rolling processes.

The object is achieved according to the invention.

The basic construction of a lubricating device, by means of which a lubricant is applied with the aid of a carrier medium, is known from the already cited EP 0 153 532 A2: In this case, a bar with a longitudinal extent comprises a first duct for delivering a lubricant and a second duct for delivering a carrier medium, wherein the first and the second ducts extend inside the bar in the longitudinal direction. The bar has a plurality of nozzles, oriented transversely to its longitudinal direction, which deliver the lubricant with the aid of the pressurized carrier medium. The nozzles are each connected to the first and the second duct so that via these connections, the supply of the individual nozzles with lubricant is carried out from the first duct and the pressurizing of the nozzles with the carrier medium is carried out from the second duct.

A further development according to the invention of such a lubricating device for applying a lubricant when rolling a rolling material comprises an extruded profile with two oppositely disposed ends between which a plurality of lubricant ducts, which are open to both profile ends, and at least one carrier-medium duct, which is open to both profile ends, extend through the extruded profile. The lubricating device also has a connection block for at least one profile end, which connection block is connected to the extruded profile at the end and has lubricant connecting ducts which in each case are connected to a lubricant duct of the extruded profile. Furthermore, the lubricating device has nozzles, connected to the extruded profile, which nozzles in each case are connected to a lubricant duct and to at least one carrier-medium duct of the extruded profile and are designed for creating and discharging a lubricant-carrier medium mixture consisting of a lubricant and a carrier medium. The carrier medium is a gas, e.g. air, or a liquid, e.g. water.

The extruded profile at the same time functions in this case as a carrier of the nozzles and as a pipe system for conducting lubricant and carrier medium to the nozzles. Such an extruded profile can be simply produced from a semi-finished product, and produced by means of an extrusion process, which already has the carrier-medium and lubricant ducts. In particular, the length of the extruded profile can be variably adapted, by simple cutting of the semi-finished product, to an extent of a lubricating region which is to be lubricated. The construction cost for the production of the lubricating device and its adaptation to parameters of roll stands and rolling processes is reduced in the main due to the positioning of the nozzles which can be flexibly designed by introducing (for example by drilling and/or milling) nozzle recesses and connecting lines between the nozzle recesses and the carrier-medium and lubricant ducts. This advantageously reduces the effort and the costs for the production of the lubricating device and enables a simple adaptation of this production to different roll stands and rolling processes.

The use of an extruded profile with carrier-medium and lubricant ducts which extend through the extruded profile also advantageously avoids sealing points which are to be sealed along a longitudinal extent of the lubricating device. These sealing points occur, for example, in a modular construction of a lubricating device from individual modules with separate carrier-medium and lubricant line sections.

The at least one connection block, which is connected to the extruded profile, with lubricant connecting ducts advantageously enables a connection of the lubricating device to a lubricant supply system which can be flexibly adapted to the length of the extruded profile.

One embodiment of the invention provides that at least one connection block has a carrier-medium connecting duct which is connected to at least one carrier-medium duct of the extruded profile. This embodiment advantageously enables a connection of the lubricating device to a carrier-medium supply system which can be flexibly adapted to the length of the extruded profile.

A further embodiment of the invention provides that the extruded profile is produced from aluminum or copper or from an aluminum alloy or a copper alloy. This embodiment advantageously reduces the weight of the lubricating device to a noticeable extent, compared with conventional lubricating devices which are typically produced from steel. As a result, the lubricating device can be manually installed and removed and exchanged without a special lifting device, such as a crane, having to be used. This appreciably simplifies and curtails the installation and removal and also the exchange and the maintenance of a lubricating device. A further advantage results from the high corrosion resistance of aluminum, copper and aluminum alloys and copper alloys, especially when water is used as the carrier medium. This is important since the water quality in rolling mills generally fluctuates a great deal or the water is often highly contaminated.

A further embodiment of the invention provides that each nozzle is connected via at least one branch duct, which is drilled into the extruded profile from the outside, to a lubricant duct of the extruded profile. Each branch duct of the extruded profile is in this case closed off toward the outside for example by a blanking plug. This embodiment of the invention enables a flexible connection of the nozzles, which is adapted to the respective positions of the nozzles, to the lubricant ducts of the extruded profile by means of branch lines which are drilled into the extruded profile from the outside.

A further embodiment of the invention provides that each nozzle is detachably connected to the extruded profile by a bayonet connection or by a screwed connection. This embodiment advantageously enables a simple installation and removal and exchange of the nozzles which, if use is made of bayonet connections for the fastening of the nozzles, can even be carried out without tools.

A further embodiment of the invention provides that at least one connection block has a lubricant deflection segment with lubricant deflection lines which in each case connect a lubricant connecting duct of the connection block to a lubricant duct of the extruded profile and deflect the lubricant. Further developments of this embodiment of the invention provide that each lubricant deflection segment has a plurality of plates arranged in a stack and optionally has a seal arranged on the plate stack, wherein the plates at the optional seal have cutouts which form the lubricant lines. These embodiments of the invention enable the lubricant to be deflected from the lubricant connecting ducts of a connection block to the lubricant ducts of the extruded profile. As a result, the lubricant connecting ducts can be routed for example along a rear side of the extruded profile. As a result, the lubricating device can be of a space saving design. The implementation of the deflection of the lubricant through cutouts in the stacked plates is advantageous since such plates can be produced in an inexpensive, precise and flexible manner, for example of laser cutting.

A further embodiment of the invention provides that each lubricant duct of the extruded profile is connected to a control valve which is arranged outside the extruded profile. The control valves enable a dosing of the lubricant flows to the nozzles. The arrangement of the control valves outside the extruded profile simplifies the maintenance and, if necessary, the exchange of the control valves and as a result simplifies the servicing of the lubricating device.

A further embodiment of the invention provides that on each of the two oppositely disposed ends of the extruded profile, a connection block is connected to the extruded profile, wherein each connection block has lubricant connecting ducts which in each case are connected to a lubricant duct of the extruded profile. Both connection blocks preferably have a carrier-medium connecting duct which is connected to each carrier-medium duct of the extruded profile. As a result, the extruded profile is sealed at both ends and also enables a feed of carrier medium and lubricant from both sides.

A further embodiment of the invention provides a nozzle protection frame which is arranged on the extruded profile around the nozzles and has recesses for the nozzles. As a result of the nozzle protection frame the nozzles can be advantageously protected against damage, for example in the event of a split in the rolling band or as a result of so-called cobbles.

In a method according to the invention for producing a lubricating device according to the invention, the extruded profile is produced by a semi-finished product, with the lubricant ducts and the at least one carrier-medium duct, being produced in an extrusion process and the semi-finished product then being cut to a length which depends on an extent of a lubricating region which is to be lubricated. Recesses for the nozzles are introduced into the semi-finished product and for each nozzle recess, at least one branch duct is drilled into the extruded profile from an outer surface of the semi-finished product in order to connect the nozzle recess to a lubricant duct which extends through the extruded profile. This method advantageously enables a flexible adaptation of the produced lubricating device to parameters of a roll stand and rolling process, as has been explained above.

The above-described characteristics, features and advantages of this invention and also the way that these are achieved become clearer and more obviously understandable in conjunction with the following description of exemplary embodiments which are explained in more detail in conjunction with the drawings. In the drawing, in this case:

DESCRIPTION OF EMBODIMENTS

Parts which correspond to each other are provided with the same designations in all the figures.

FIGS. 1 to 7 show different views and partial views of a lubricating device 1 for applying a lubricant when rolling a rolling material.

Figure 1:
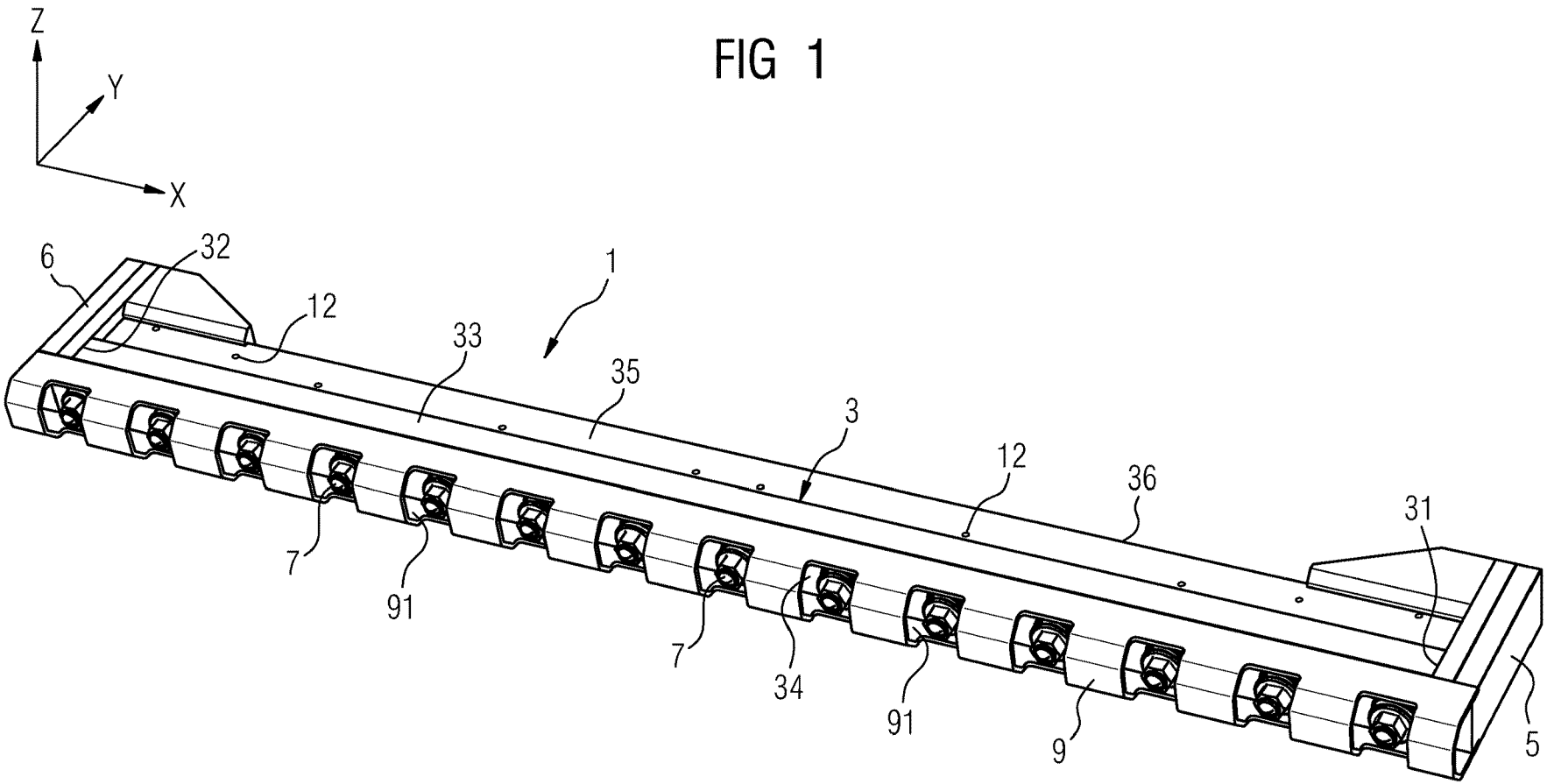
FIG. 1 shows a perspective view of a lubricating device.

FIG. 1 shows a perspective view of the entire lubricating device 1. The lubricating device 1 comprises an extruded profile 3, two connection blocks 5, 6, a plurality of nozzles 7 and a nozzle protection frame 9.

The extruded profile 3 is an elongate body which extends along its longitudinal axis between two ends 31, 32 of the extruded profile 3. The extruded profile 3 has a front-side section 33 with a front side 34 of the extruded profile 3 and a rear-side section 35 with a rear side 36 of the extruded profile 3 opposite the front side 34, wherein the front side 34 and the rear side 36 each extend in the longitudinal direction of the extruded profile 3, i.e. parallel to its longitudinal axis. The front side 34 faces a surface to which the lubricant is applied.

A first connection block 5 is arranged on a first end 31 of the extruded profile 3 and the second connection block 6 is arranged on the second end 32 of the extruded profile 3.

The nozzles 7 are installed next to each other in the front-side section 33 of the extruded profile 3 along a straight line which is parallel to the longitudinal axis of the extruded profile 3 (see FIGS. 3 to 5 for this), wherein they project in each case from the extruded profile 3 on the front side 34 of said extruded profile 3.

The nozzle protection frame 9 is arranged on the extruded profile 3, encloses the front side 34 of the extruded profile 3 in the manner of a cap, and extends parallel to the longitudinal axis of the extruded profile 3. The nozzle protection frame 9 is configured as a profile with a U-shaped cross section, which has a respective recess 91 for each nozzle 7. The nozzle protection frame 9 projects further than the nozzles 7 from the front side 34 of the extruded profile 3 in order to protect the nozzles 7 against damage.

For better understanding, a Cartesian coordinate system, with coordinates X, Y, Z, which is related to the extruded profile 3, is shown in each case in FIGS. 1 to 7, the X-axis of the coordinate system being parallel to the longitudinal axis of the extruded profile 3. The Y-axis of the coordinate system extends through the front side 34 and through the rear side 36 of the extruded profile 3.

In the exemplary embodiment shown in FIGS. 1 to 7, the front side 34 and the rear side 36 of the extruded profile 3 are constructed flat and perpendicular to the direction of the Y-axis in each case. Also, the profile ends 31, 32 in this exemplary embodiment are surfaces of the extruded profile 3 which are perpendicular to the longitudinal axis of said extruded profile 3 and therefore parallel to a YZ-plane of the coordinate system in each case.

Figure 2:
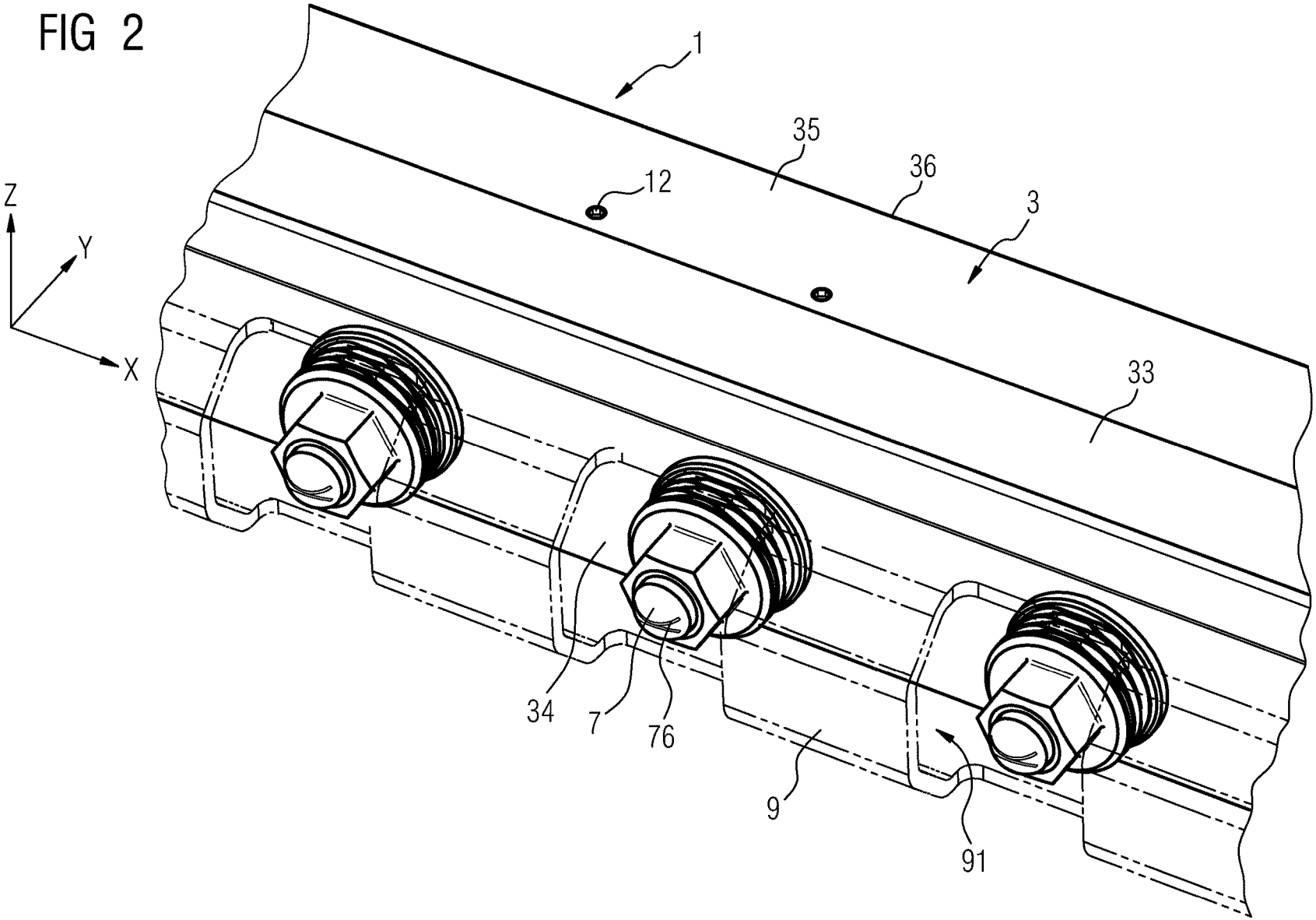
FIG. 2 shows a perspective view of a section of a lubricating device.
Figure 3:
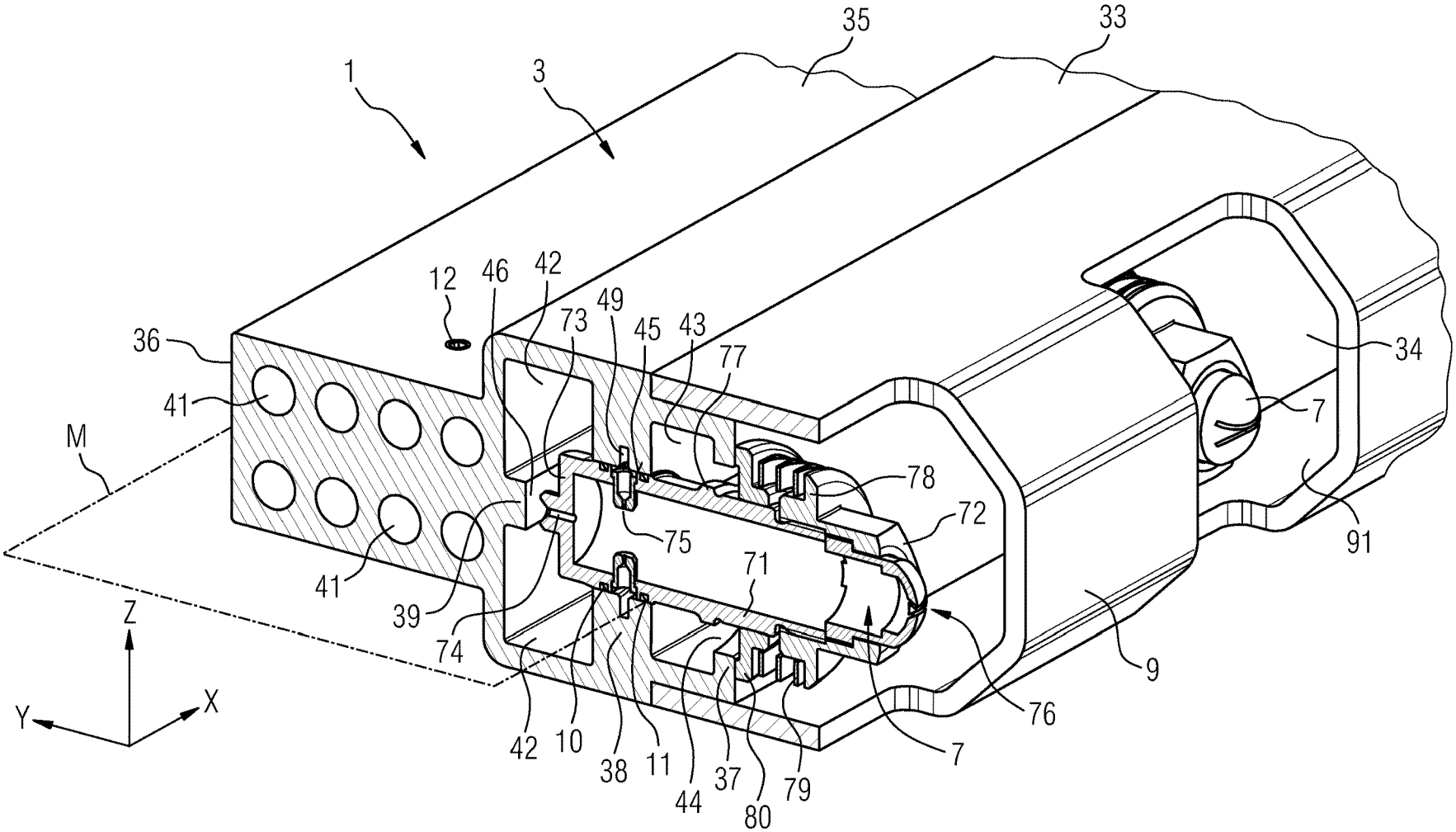
FIG. 3 shows a perspective sectional view of a section of a lubricating device.
Figure 4:
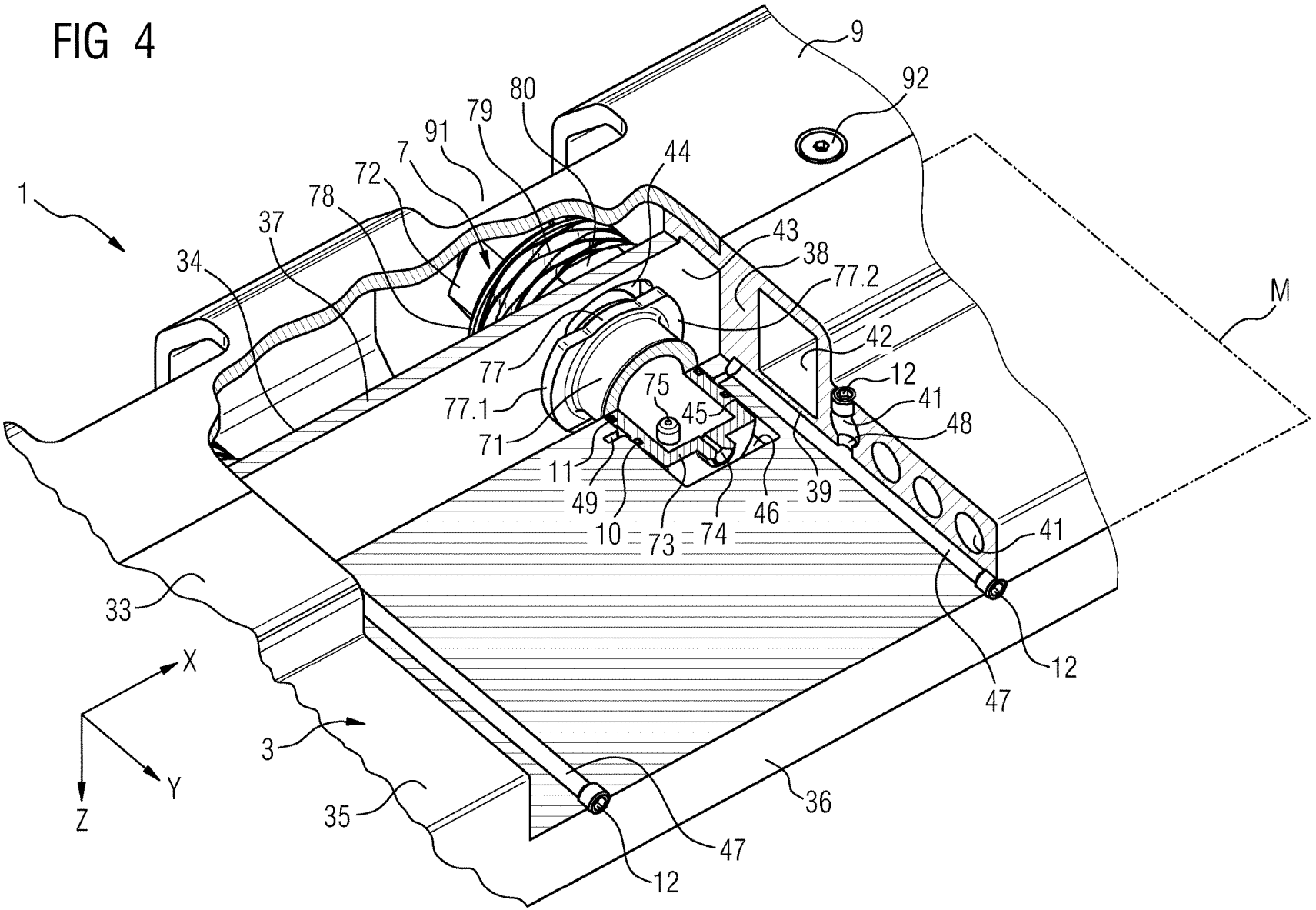
FIG. 4 shows a perspective view of a broken out section of a lubricating device.

FIGS. 2 to 4 show the extruded profile 3, the nozzles 7 and the nozzle protection frame 9 of the lubricating device 1 in detail. FIG. 2 shows a perspective view of the extruded profile 3, of the nozzles 7 which are fastened thereupon and of the nozzle protection frame 9, wherein the nozzle protection frame 9 is shown transparently. FIG. 3 shows a perspective sectional view of a section of the lubricating device 1 with a sectional plane which is parallel to the YZ-plane and which extends through a nozzle 7. FIG. 4 shows a perspective view of a section of the lubricating device 1 which is shown broken out and sectioned several times in the region of a nozzle 7.

A plurality (eight in the depicted exemplary embodiment) of lubricant ducts 41, two carrier-medium ducts 42 and a nozzle fastening recess 43 extend through the extruded profile 3 parallel to its longitudinal axis. The lubricant ducts 41, the carrier-medium ducts 42 and the nozzle fastening recess 43 extend in each case over the entire longitudinal extent of the extruded profile 3 and are open in each case to both ends 31, 32 of the extruded profile 3.

The lubricant ducts 41 extend through the rear-side section 35 of the extruded profile 3. The lubricant ducts 41 form two rows of lubricant ducts 41 (two rows of four lubricant ducts 41 each in the depicted exemplary embodiment), wherein the two rows are arranged on different sides of a center plane M of the extruded profile 3. The lubricant ducts 41 of each row are arranged next to each other along a straight line which is parallel to the Y-axis. The center plane M extends through the extruded profile 3 parallel to an XY-plane of the coordinate system and is at least approximately a symmetry plane of the extruded profile 3.

The carrier-medium ducts 42 and the nozzle fastening recess 43 extend through the front-side section 33 of the extruded profile 3. In this case, the carrier-medium ducts 42 extend at a greater distance from the front side 34 of the extruded profile 3 than the nozzle fastening recess 43, i.e. the carrier-medium ducts 42 extend through the extruded profile 3 between the nozzle fastening recess 43 and the lubricant ducts 41. The carrier-medium ducts 42 extend on different sides of the center plane M. The nozzle fastening recess 43 is constructed symmetrically to the center plane M.

The nozzle fastening recess 43 is delimited on the front side, i.e. toward the front side 34 of the extruded profile 3, by a front wall 37, the outer surface of which forms the front side 34 of the extruded profile 3. On the rear side, i.e. toward the rear side 36 of the extruded profile 3, the nozzle fastening recess 43 is delimited by an intermediate wall 38 of the extruded profile 3 which separates the nozzle fastening recess 43 from the carrier-medium ducts 42. The carrier-medium ducts 42 are separated from each other by means of a dividing wall 39 which extends from the intermediate wall 38 to the rear-side section 35 of the extruded profile 3.

Each nozzle 7 is inserted in a nozzle recess 44, 45, 46 in the extruded profile 3. Each nozzle recess 44, 45, 46 consists of a recess 44 in the front wall 37, a recess 45 in the intermediate wall 38 and a recess 46 in the dividing wall 39.

Each nozzle 7 is designed for creating and delivering a lubricant-carrier medium mixture consisting of lubricant and a carrier medium. Each nozzle 7 has a body 71 and a head 72 which is connected to the body 71.

The nozzle body 71 is a basically cylindrical hollow body which on one side is closed off by a nozzle bottom 73 and open toward the nozzle head 72. The nozzle bottom 73 has a carrier-medium inlet 74 for introducing carrier medium into the nozzle 7. The nozzle body 71 also has two lubricant inlets 75 for introducing lubricant into the nozzle 7, wherein the lubricant inlets 75 are arranged equidistantly from the nozzle bottom 73.

The nozzle head 72 is seated on the nozzle body 71 in the manner of a cap and has a nozzle outlet 76 for delivering the lubricant-carrier medium mixture.

Each nozzle 7 is detachably connected to the extruded profile 3 by means of a bayonet connection 77 to 80. The bayonet connection 77 to 80 comprises a bayonet collar 77, a support collar 78, a clamping spring 79 and a clamping ring 80. The bayonet collar 77, the support collar 78, the clamping spring 79 and the clamping ring 80 extend annularly in each case around an axis of the nozzle which extends between the nozzle bottom 73 and the nozzle head 72.

The bayonet collar 77 is part of the nozzle body 71 and is arranged between the lubricant inlets 75 and the nozzle head 72. The bayonet collar 77 projects outward from the rest of the nozzle body 71, wherein it has two oppositely disposed segments 77.1, 77.2 which project further outward than the regions of the bayonet collar 77 which lie between them. The front wall recess 44 has a contour which corresponds to the bayonet collar 77 so that the bayonet collar 77 can be guided through the front-wall recess 44 only in a precisely fitting position relative to said front-wall recess 44.

The support collar 78 is part of the nozzle head 72 and projects outward in the manner of a circular ring from the rest of the nozzle head 72.

The clamping ring 80 is arranged between the bayonet collar 77 and the nozzle head 72 and extends annularly around the outer surface of the nozzle body 71, wherein it can be displaced along the nozzle axis in relation to the nozzle body 71. An outside diameter of the clamping ring 80 is larger than the diameter of the front-wall recess 44 so that it cannot be guided through said front-wall recess 44.

The clamping spring 79 is arranged between the support collar 78 of the nozzle head 72 and the clamping ring 80 and is supported by a front-side end on the support collar 78 and by a rear-side end on the clamping ring 80. The clamping spring 79 can be elastically deformed and pretensioned in the direction of the nozzle axis so that it exerts a restoring force upon the clamping ring 80 in the direction of the bayonet collar 77.

The intermediate-wall recesses 45 and the dividing-wall recesses 46 are designed in each case for accommodating a rear-side section of the body 71 of a nozzle 7, wherein each dividing-wall recess 46 connects both carrier-medium ducts 42 to the carrier-medium inlet 74 in the bottom 73 of a nozzle 7.

In order to fasten a nozzle 7 on the extruded profile 3, the nozzle 7 is inserted from the front side 34 into a nozzle recess 44, 45, 46, wherein the bayonet collar 77 is guided through the front-wall recess 44 in a precisely fitting manner. The nozzle 7 is then rotated by approximately 90 degree around it rotational axis and released. As a result, the collar segments 77.1, 77.2 butt against the rear-side surface of the front wall 37 and the clamping ring 80 butts against the front-side surface of the front wall 37. The clamping spring 79 also exerts a restoring force upon the clamping ring 80 which presses the clamping ring 80 onto the front wall 37 and therefore fastens the nozzle 7 in the extruded profile 3. In order to remove a nozzle 7 from the extruded profile 3 (for example in order to exchange a nozzle 7), the nozzle 7 is correspondingly rotated around its axis until its bayonet collar 77 can be guided through the front-wall recess 44 and the nozzle 7 is then withdrawn from the nozzle recess 44, 45, 46. In this way, the bayonet connection 77 to 80 advantageously enables a removable and tool-free installation, removal and exchange of nozzles 7.

Each nozzle 7 is connected via a first branch duct 47 and a second branch duct 48 to a lubricant duct 41 which extends through the extruded profile 3.

Each first branch duct 47 extends in a straight line from the rear side 36 of the extruded profile 3 parallel to the Y-axis between the two rows of lubricant ducts 41 through the rear-side section 35 of the extruded profile 3, through the dividing wall 39 up to the intermediate wall 38 and terminates in the intermediate wall 38 level with the lubricant inlets 75 of a nozzle 7, which is fastened in the extruded profile 3, to which extends the first branch duct 47.

Each second branch duct 48 extends from the outside parallel to the Z-axis through the rear-side section 35 of the extruded profile 3 to a lubricant duct 41 and from this lubricant duct 41 to a first branch duct 47 and consequently connects the lubricant duct 41 to the first branch duct 47.

Each intermediate-wall recess 45 has an annular widened portion 49 which extends level with the lubricant inlets 75 of a nozzle 7 which is inserted in nozzle recess 44, 45, 46 by means of this intermediate wall recess 45. The widened portion 49 of the intermediate-wall recess 45, after insertion of the nozzle 7, therefore forms an annular passage around the body 71 of this nozzle 7 level with its lubricant inlets 75. The first branch duct 47, which extends to this nozzle 7, extends to the recess widened portion 49 and consequently connects this via a second branch duct 48 to a lubricant duct 41.

The annular passage, which is formed by a widened portion 49 of the recess, around the body 71 of a nozzle 7 is sealed by two sealing rings 10, 11 which are introduced into the outer surface of the body 71 of the nozzle 7, extend around the axis of the nozzle 7 and butt against the intermediate wall 38. In this case, a first sealing ring 10 has a shorter distance to the nozzle bottom 73 than the lubricant inlets 75 and seals the annular passage on the rear side. The second sealing ring 11 has a greater distance to the nozzle bottom 73 than the lubricant inlets 75 and seals the annular passage on the front side.

Each dividing-wall recess 46 is constructed to such depth that it connects both carrier-medium ducts 42 with the carrier-medium inlet 74 of a nozzle 7 which is inserted into the associated nozzle recess 44, 45, 46.

Each branch duct 47, 48 is closed off to the outside by a blanking plug 12.

FIG. 4 also shows one of a plurality of screwed connections 92 by means of which the nozzle protection frame 9 is fastened on the extruded profile 3.

Figure 5:
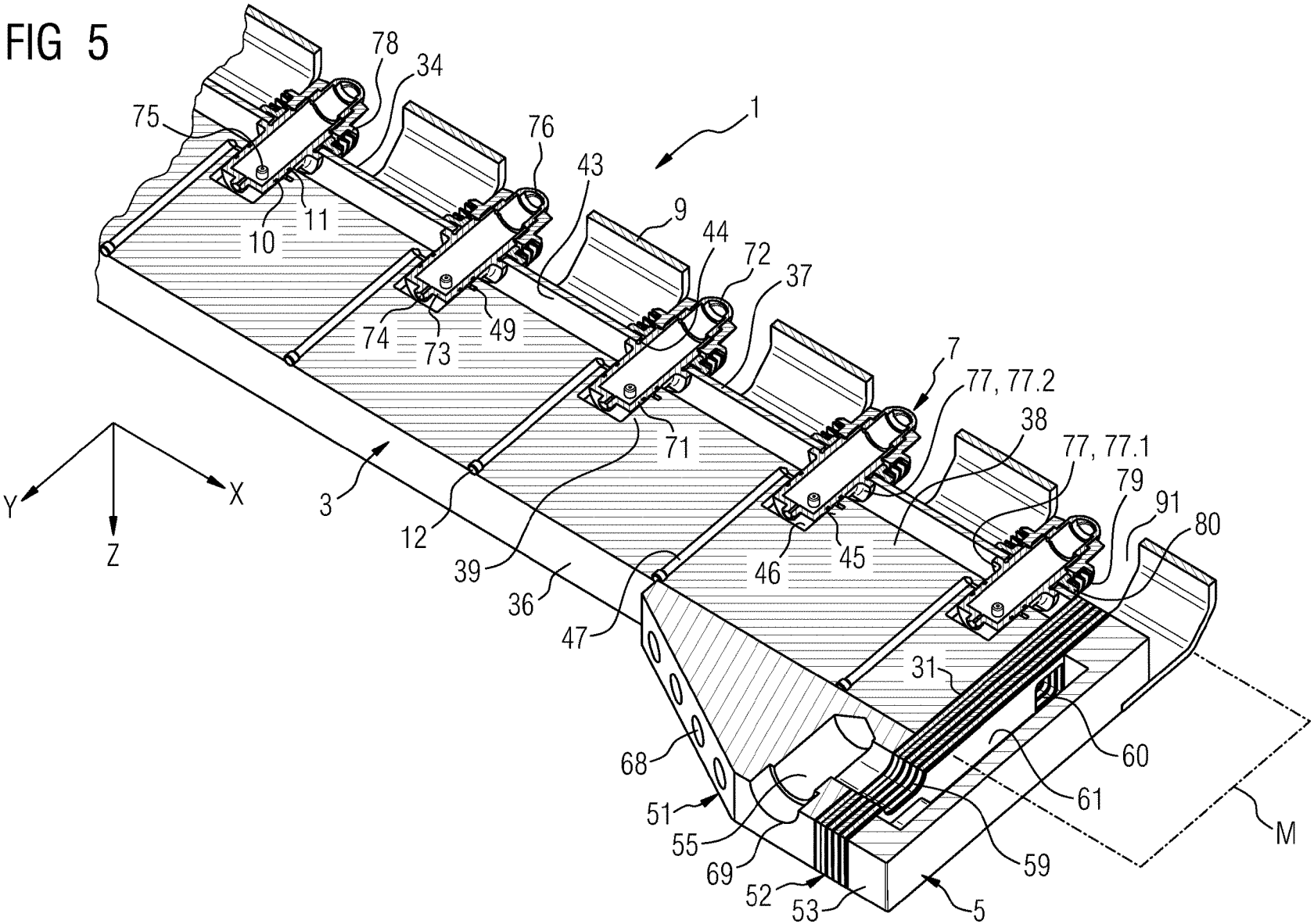
FIG. 5 shows a perspective sectional view of an end section of a lubricating device.
Figure 6:
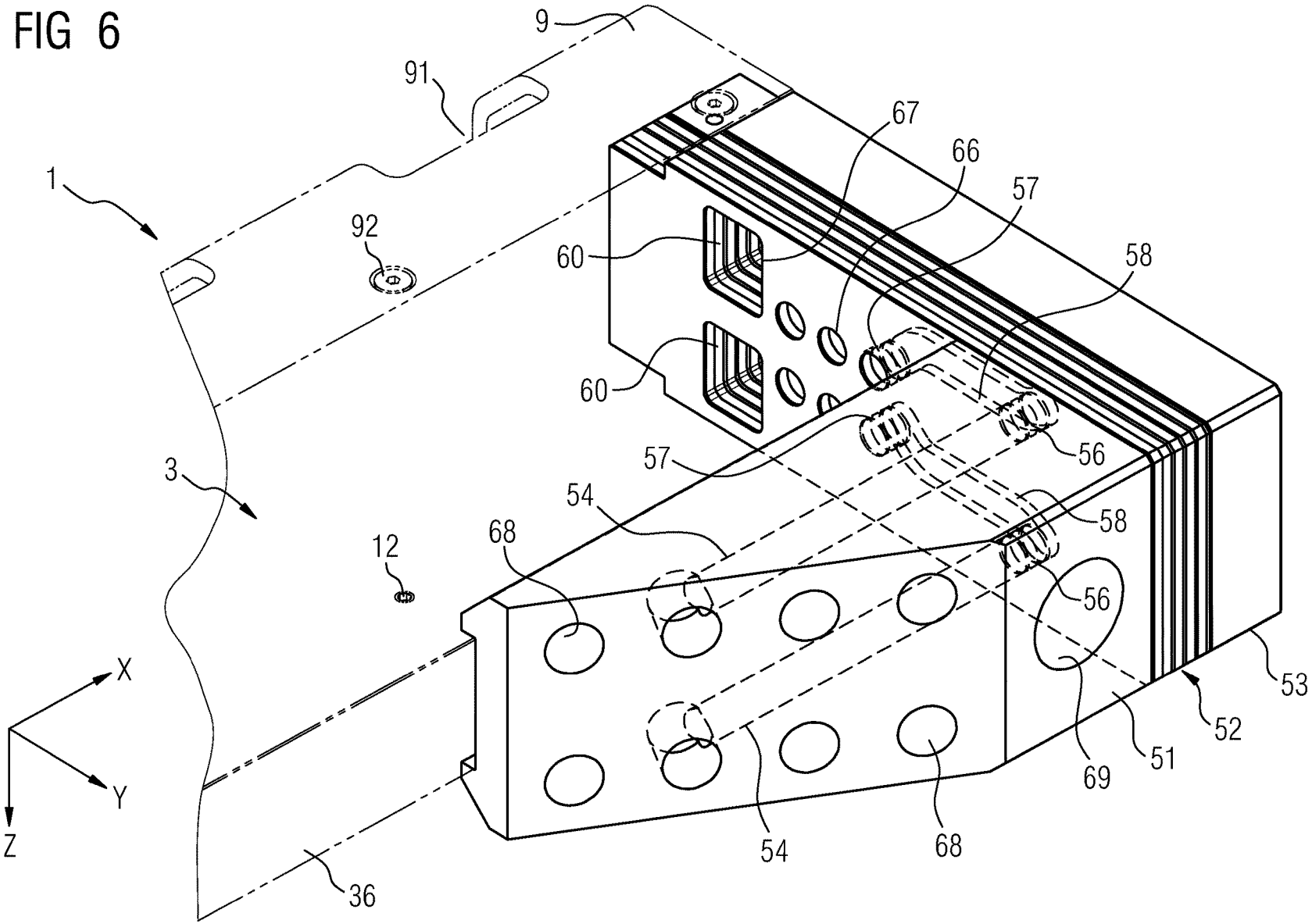
FIG. 6 shows a perspective view of an end section of a lubricating device.
Figure 7:
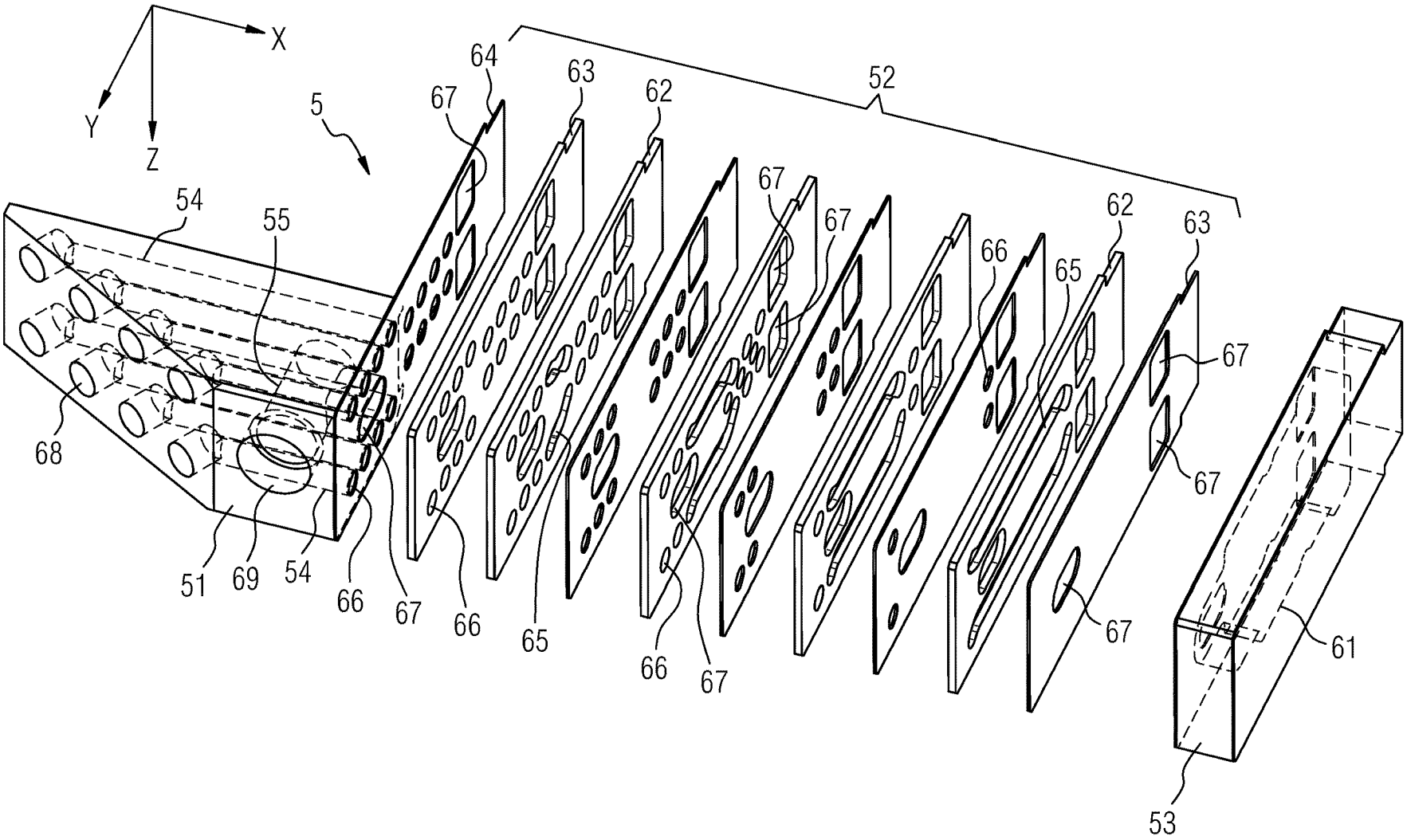
FIG. 7 shows a perspective exploded view of a connection block of a lubricating device.

FIGS. 5 to 7 show the first connection block 5 and its connection to the extruded profile 3. FIG. 5 shows a perspective sectional view of an end section of the lubricating device 1, having the first connection block 5, with the center plane M as the sectional plane. FIG. 6 shows a perspective view of the first connection block 5 and transparently depicted end sections of the extruded profile 3 and of the nozzle protection frame 9. FIG. 7 shows a perspective exploded view of the first connection block 5 of the lubricating device 1. The second connection block 6 is of similar design to the first connection block 5. Therefore, only the first connection block 5 is described in the following text.

The first connection block 5 comprises a connection segment 51, a lubricant deflection segment 52 and a carrier-medium deflection segment 53.

The connection segment 51 butts against the rear side 36 of the extruded profile 3 and terminates on the profile-end side flush with the first end 31 of the extruded profile 3. As a result, the connection segment 51 does not project to the side from the extruded profile 3, which effects a space-saving design of the lubricating device 1 which in particular enables a quick installation and removal of the lubricating device 1 in a roll train. The lubricant deflection segment 52 butts against the first end 31 of the extruded profile 3 and against the connection segment 51. The carrier-medium deflection segment 53 butts against a side of the lubricant deflection segment 52 which faces away from the extruded profile 3.

A plurality (eight in the depicted exemplary embodiment) of lubricant connecting ducts 54 and a carrier-medium connecting duct 55 extend through the connection segment 51 to the lubricant deflection segment 52. FIG. 5 shows the path of the carrier-medium connecting duct 55 by way of example, FIG. 6 shows the path of two lubricant connecting ducts 54, and shown in FIG. 7 is the path of all the lubricant connecting ducts 54 and of the carrier-medium connecting duct 55.

A plurality (eight in the depicted exemplary embodiment) of lubricant lines 56, 57, 58 extend in the lubricant deflection segment 52 and in each case connect a lubricant connecting duct 54 of the first connection block 5 to a lubricant duct 41 of the extruded profile 3 and deflect the lubricant from the lubricant connecting duct 54 to the lubricant duct 41.

Each connecting line 56, 57, 58 consists of a lubricant connecting duct extension 56, which extends a lubricant connecting duct 54 of the connection segment 51 in a straight line into the lubricant deflection segment 52, a lubricant duct extension 57, which extends a lubricant duct 41 of the extruded profile 3 in a straight line into the lubricant deflection segment 52, and a lubricant connecting duct 58, which connects a lubricant connecting duct extension 56 to a lubricant duct extension 57.

Also extending through the lubricant deflection segment 52 is a carrier-medium connecting duct extension 59, which extends the carrier-medium connecting duct 55 of the connection segment 51 to the carrier-medium deflection segment 53, and two carrier-medium duct extensions 60, which in each case extend one of the two carrier-medium ducts 42 of the extruded profile 3 to the carrier-medium deflection segment 53.

Extending in the carrier-medium deflection segment 53 is a carrier-medium connecting duct 61, which connects the carrier-medium connecting duct extension 59 to the two carrier-medium duct extensions 60 and deflects the carrier medium.

The lubricant deflection segment 52 comprises a plurality of plates 62, 63 arranged in a stack and, as an option, a plate-like seal 64 which is arranged between the plate stack and the extruded profile 3 and the connection segment 51. The plates 62, 63 and the seal 64 each have cutouts 65 to 67 which form the lubricant lines 56, 57, 58, the carrier-medium connecting duct extension 59 and carrier-medium duct extensions 60.

The plate stack is formed from connecting plates 62 and separating plates 63 which alternate with each other so that a connecting plate 62 is arranged between two separating plates 63 in each case.

Each lubricant connecting duct 58 is formed by just an elongate connecting cutout 65 in a connecting plate 62. The lubricant connecting duct extension 56 which is connected to a lubricant connecting duct 58 and the lubricant duct extension 57 which is connected to this lubricant connecting duct 58 are formed in each case by means of series-arranged, mutually corresponding stack cutouts 66 in all the plates 62, 63, which are arranged between the seal 64 and the connecting plate 62 forming the lubricant connecting duct 58, and also in the seal 64. Each connecting cutout 65 in a connecting plate 62 is completely covered by the separating plate 63 which is arranged behind the connecting plate 62 and covered by the separating plate 63 which is arranged in front to the connecting plate 62 apart from those regions which lie behind stack cutouts 66 in this separating plate 63. In this case, a plate 62, 63 is referred to as being arranged behind another plate 62, 63 if it lies closer to the carrier-medium deflection segment 53. The same applies to the cutouts 65 to 67.

In the depicted exemplary embodiment, each connecting plate 62 has two connecting cutouts 65 and with the adjacent separating plates 63 correspondingly forms two lubricant connecting ducts 58.

The carrier-medium connecting duct extension 59 and the carrier-medium duct extensions 60 are formed in each case by series-arranged, mutually corresponding carrier-medium duct cutouts 67 in all the plates 62, 63 and in the seal 64.

Apart from the front separating plate 63 which is arranged directly behind the seal 64, the separating plates 63 have a smaller thickness than the connecting plates 62.

In the depicted exemplary embodiment, for each lubricant connecting duct 54 the connection segment 51 has a lubricant connecting opening 68 and for the carrier-medium connecting duct 55 has a carrier-medium connecting opening 69 toward a rear-side outer side of the connection segment 51. In this case, the carrier-medium connecting opening 69 is located closer to the lubricant deflection segment 52 than the lubricant connecting openings 68. Furthermore, the rear-side outer side of the connection segment 51 in the region of the lubricant connecting openings 68 is beveled in relation to the rear side 36 of the extruded profile 3, wherein its distance from the rear side 36 of the extruded profile 3 reduces as distance from the lubricant deflection segment 52 increases.

The extruded profile 3 is produced for example from aluminum or copper or from an aluminum alloy or a copper alloy.

The seal 64 is produced for example from nitrile rubber or fluorinated rubber.

The plates 62, 63 are produced for example from stainless steel or from an aluminum alloy.

When producing an above-described lubricating device 1, the extruded profile 3 is produced by a semi-finished product, with the lubricant ducts 41, carrier-medium ducts 42 and the nozzle fastening recess 43, being first of all produced in an extrusion process. The semi-finished product is then cut to a length which depends on an extent of a lubricating region which is to be lubricated. Introduced into the semi-finished product are the recesses 44, 45, 46 for the nozzles 7, the widened portions 49 in the intermediate wall recesses 45 and the branch ducts 47, 48, for example by drilling and/or milling in each case. The branch ducts 47, 48 are then closed off by means of blanking plugs 12.

When producing the connection blocks 5, 6, the cutouts 65 to 67 in the plates 62, 63 are cut out for example by means of laser cutting. The plates 62, 63 of a lubricant deflection segment 52 are adhesively fastened to each other in a fluidtight manner, forming a plate stack, and then screwed to each other.

After producing the extruded profile 3 and the connection blocks 5, 6, each connection block 5, 6 is fastened to an end 31, 32 of the extruded profile 3 (for example by means of screwed connections which are not shown in FIGS. 1 to 7), the nozzles 7 are inserted in each case, as described above, in a nozzle recess 44, 45, 46 of the extruded profile 3, and the nozzle protection frame 9 is fastened on the extruded profile 3 by means of the screwed connections 92.

During operation of the lubricating device 1, its front side 34 faces a surface onto which lubricant is to be delivered, for example a surface of a roller of a roll stand or a surface of a rolling material. Through the lubricant connecting openings 68 of the connection blocks 5, 6, a lubricant is fed to the lubricating device 1, the lubricant being directed via the connection blocks 5, 6 and the lubricant ducts 41 and branch ducts 47, 48 of the extruded profile 3 to the nozzles 7. At the same time, a carrier medium is fed through the carrier-medium connecting openings 69 of the connection blocks 5, 6 to the lubricating device 1, the carrier medium being directed via the connection blocks 5, 6 and the carrier-medium ducts 42 to the nozzles 7. The lubricant is for example a rolling oil.

The carrier medium is a gas, e.g. air, or a liquid, e.g. water.

From the lubricant and carrier medium which are fed to it, each nozzle 7 creates a lubricant-carrier medium mixture and delivers this in the form of a spray jet through its nozzle outlet 76.

Although the invention has been fully illustrated and described in detail by means of the preferred exemplary embodiments, the invention is not limited by the disclosed examples and other variations can be derived therefrom by the person skilled in the art without departing from the extent of protection of the invention.

LIST OF DESIGNATIONS

1 Lubricating device
3 Extruded profile
5, 6 Connection block
7 Nozzle
9 Nozzle protection frame
10, 11 Sealing ring
12 Blanking plug
31, 32 Profile end
33 Front-side section
34 Front side
35 Rear-side section
36 Rear side
37 Front wall
38 Intermediate wall
39 Dividing wall
41 Lubricant duct
42 Carrier-medium duct
43 Nozzle fastening recess
44 Front-wall recess
45 Intermediate-wall recess
46 Dividing-wall recess
47, 48 Branch duct
49 Widened portion of recess
51 Connection segment
52 Lubricant deflection segment
53 Carrier-medium deflection segment
54 Lubricant connecting duct
55 Carrier-medium connecting duct
56 Lubricant connecting duct extension
57 Lubricant duct extension
58 Lubricant connecting duct
59 Carrier-medium connecting duct extension
60 Carrier-medium duct extension
61 Carrier-medium connecting duct
62 Connecting plate
63 Separating plate
64 Seal
65 Connecting cutout
66 Stack cutout
67 Carrier-medium duct cutout
68 Lubricant connecting opening
69 Carrier-medium connecting opening
71 Nozzle body
72 Nozzle head
73 Nozzle bottom
74 Carrier-medium inlet
75 Lubricant inlet
76 Nozzle outlet
77 Bayonet collar
77.1, 77.2 Collar segment
78 Support collar
79 Clamping spring
80 Clamping ring
91 Frame recess
92 Screwed connection
M Center plane
X, Y, Z Cartesian coordinates

The invention claimed is:

1. A lubricating device for applying a lubricant when rolling a rolling material, the lubricating device comprising: an extruded profile with two oppositely disposed profile ends, a plurality of lubricant ducts which extend between and are open to both profile ends, and at least one carrier-medium duct, which is open to both profile ends and extends through the extruded profile; a connection block for one of the profile ends, the connection block is connected to the extruded profile at the one of the profile ends, the connection block has lubricant connecting ducts and each lubricant connecting ducts is connected to a lubricant duct of the extruded profile; and a plurality of nozzles connected to the extruded profile, each nozzle is connected to one of the lubricant ducts and to at least one of the carrier-medium ducts of the extruded profile, and each nozzle is configured for creating and delivering a lubricant-carrier medium mixture consisting of the lubricant and a carrier medium.

2. The lubricating device as claimed in claim 1, further comprising at least one of the connection blocks has one of the carrier-medium connecting ducts connected to at least one carrier-medium duct of the extruded profile.

3. The lubricating device as claimed in claim 1, wherein the extruded profile is comprised of aluminum, copper, an aluminum alloy or a copper alloy.

4. The lubricating device as claimed in claim 1, further comprising each nozzle is connected to a lubricant duct of the extruded profile via at least one branch duct which has been drilled from an outside into the extruded profile.

5. The lubricating device as claimed in claim 4, further comprising each branch duct of the extruded profile is closed off to the outside of the branch duct by a blanking plug.

6. The lubricating device as claimed in claim 1, further comprising each nozzle is detachably connected to the extruded profile by a bayonet connection or by means of a screwed connection.

7. The lubricating device as claimed in claim 1, further comprising the connection block has a lubricant deflection segment including lubricant lines which each connect one of the lubricant connecting ducts of the connection block to one of the lubricant ducts of the extruded profile and deflect the lubricant in the profile.

8. The lubricating device as claimed in claim 7, further comprising the lubricant deflection segment includes a plurality of plates arranged in a stack, the plates have cutouts therethrough and the cutouts of successive plates form the lubricant lines.

9. The lubricating device as claimed in claim 7, further comprising the lubricant deflection segment includes a plurality of plates arranged in a stack and a seal which is arranged on the plate stack, wherein the plates and the seal have respective cutouts therethrough and the cutouts of successive plates and the seal form the lubricant lines.

10. The lubricating device as claimed in claim 1, further comprising: a control valve arranged outside the extruded profile that is connected to each of the lubricant ducts of the extruded profile.

11. The lubricating device as claimed in claim 1, further comprising: another connection block connected to the other end of the extruded profile, wherein the other connection block has lubricant connecting ducts each connected to a lubricant duct of the extruded profile.

12. The lubricating device as claimed in claim 11, further comprising both connection blocks have a respective carrier-medium connecting duct which is connected to one of the carrier-medium ducts of the extruded profile.

13. The lubricating device as claimed in claim 1, further comprising a nozzle protection frame, including a respective recess for each of the nozzles, and each recess is arranged in the extruded profile around the respective nozzle.

14. A method for producing a lubricating device as claimed in claim 1, wherein the extruded profile is produced by producing a semi-finished product, with the lubricant ducts and the at least one carrier-medium duct, wherein the producing is performed in an extrusion process; by cutting the semi-finished product to a length which depends on an extent of a lubricating region which is to be lubricated; by introducing recesses for each of the nozzles introduced into the semi-finished product; and by forming at least one branch duct into the extruded profile from an outer surface of the semi-finished product for each nozzle recess, for enabling connection of the nozzle recess to a lubricant duct which extends through the extruded profile.

* * * * *